US006211115B1

(12) United States Patent
Loccufier et al.

(10) Patent No.: US 6,211,115 B1
(45) Date of Patent: Apr. 3, 2001

(54) REDUCING AGENTS FOR USE IN THERMOGRAPHIC RECORDING MATERIALS

(75) Inventors: Johan Loccufier, Zwijnaarde; Bart Horsten, Rumst; Peter Slabbinck, Knokke-Heist, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/352,420

(22) Filed: Jul. 12, 1999

Related U.S. Application Data

(60) Provisional application No. 60/105,224, filed on Oct. 22, 1998.

(30) Foreign Application Priority Data

Aug. 7, 1998 (EP) ..... 98202688

(51) Int. Cl.[7] ..... B41M 5/26
(52) U.S. Cl. ..... 503/201; 503/202; 503/212
(58) Field of Search ..... 503/201, 202, 503/212

(56) References Cited

FOREIGN PATENT DOCUMENTS 248405 2/1987 (EP) .
692733 1/1996 (EP) .
09142029 3/1997 (EP) .

*Primary Examiner*—Bruce H. Hess
(74) *Attorney, Agent, or Firm*—Baker Botts L.L.P.

(57) ABSTRACT

A substantially light-insensitive black and white monosheet thermographic recording material comprising a support and a thermosensitive element containing a substantially light-insensitive organic silver salt, a 1,2-dihydroxyphenyl-compound in thermal working relationship therewith and a binder, wherein the 1,2-dihydroxyphenyl-compound is represented by formula (I):

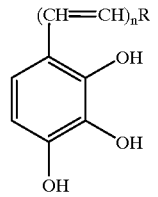

where n is 0 or 1; R is —(C═O)$R^1$, —(C═O)$NR^1R^2$, —CN, —$SO_3R^2$, —$SO_2R^2$, —$SOR^2$, —$SO_2NR^2R^3$ or —$PO_3R^2R^3$; $R^1$ is H or an alkyl group with 12 or less carbon atoms; and $R^2$ and $R^3$ are independently H or an alkyl or an aryl group; and $R^1$ and $R^2$ together can provide the atoms to close a carbocyclic or heterocyclic ring; and $R^2$ and $R^3$ together can represent the atoms to close a carbocyclic or heterocyclic ring; and a recording process therefor.

8 Claims, No Drawings

REDUCING AGENTS FOR USE IN THERMOGRAPHIC RECORDING MATERIALS

The application claims the benefit of U.S. Provisional Application No. 60/105,224 filed Oct. 22, 1998.

FIELD OF THE INVENTION

The present invention concerns black and white substantially light-insensitive thermographic recording materials containing a substantially light-insensitive organic silver salt and a novel reducing agent.

BACKGROUND OF THE INVENTION

Thermal imaging or thermography is a recording process wherein images are generated by the use of thermal energy. Most of the "direct" thermographic recording materials are of the chemical type in which upon heating an irreversible chemical reaction takes place and a coloured image is produced.

EP-A 248 405 discloses a thermal recording material with a colour-developing layer, which contains an electron acceptor and an electron donor in addition to the usual additives, characterized in that the electron acceptor is a metallic double salt of a long-chain fatty acid with 16 to 35 carbon atoms and the electron donor is a polyhydric aromatic compound of formula (I):

(I)

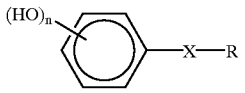

wherein R is an alkyl group with 18 to 35 carbon atoms,

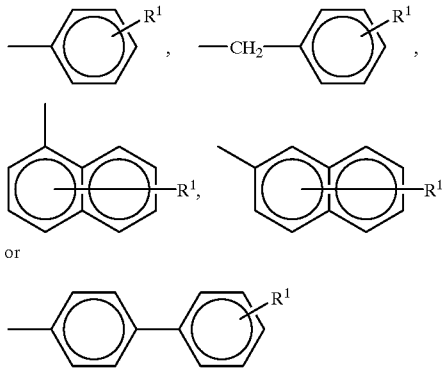

wherein $R_1$ is a $C_{18}$- to $C_{35}$-alkyl group, n is an integer of 2 or 3, —X— is —$CH_2$—, —$CO_2$—, —CO—, —O—, —CONH—, —CO(R')N— (wherein R' is a $C_{18}$- to $C_{35}$-group), —$SO_2$—, —$SO_3$— or —$SO_2$NH—. Example 4 concerns a thermosensitive recording material with a colour-developing layer containing silver aluminium double salt of octadecyl 2,3,4-trihydroxybenzoate.

EP-A 599 580 discloses a thermal recording sheet comprising, in order: (a) a substrate; (b) an intermediate layer which comprises a pigment having an oil absorption according to Japanese Industrial Standard (JIS) K501 of 100 mL/100 g or less; and (c) a thermal color developing layer which comprises a leuco dye type chromogenic component consisting of a leuco dye and an organic color developer and a metal chelate type chromogenic component consisting of an electron acceptor and an electron donor, wherein: the organic color developer is at least one of compounds of formula (I) and formula (II):

(I)

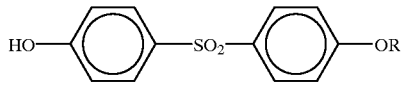

wherein R is propyl, isopropyl, or butyl;

(II)

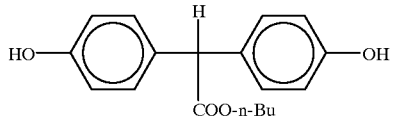

the electron acceptor is a metal double salt of a fatty acid having 16 to 35 carbon atoms; and the electron donor is a polyhydric aromatic compound of formula (III), which is the same as formula (I) of EP-A 248 405.

JP 09142029 discloses a recording layer containing at least one kind of aminobenzene sulfonamide derivative shown by formula I, at least one kind of multi-value phenolic compound, shown by formula II [same formula as formula I of EP-A 248 405 wherein X=—$CH_2$—, —$CO_2$—, —CO—, —O—, —CONH—, —CON(R')—] and a high class aliphatic metallic salt, is formed on the supporting body of a heat sensitive recording body.

The thermosensitivity of organic silver salt/reducing agent systems is dependent upon the choice of reducing agent. However, increased thermosensitivity is generally associated with poorer image gradation i.e. dependence of image density upon applied thermal energy, reduced stability and poorer image colour. There is therefore a need for reducing agents which increase the thermosensitivity of organic silver salt/reducing agent systems without substantially affecting the gradation, stability and image colour of prints made therewith.

OBJECTS OF THE INVENTION

It is therefore an object of the present invention to provide thermographic recording materials with increased thermosensitivity without significantly affecting the gradation, stability and image colour of prints made therewith.

Further objects and advantages of the invention will become apparent from the description hereinafter.

SUMMARY OF THE INVENTION

Surprisingly it has been found that prints of thermographic recording materials containing novel 3,4-dihydroxyphenyl compounds exhibit increased thermosensitivity without significantly affecting the gradation, stability and image colour of prints made therewith. In fact there is even a marginal improvement in image colour.

The above-mentioned objects are realized by a substantially light-insensitive black and white monosheet thermographic recording material comprising a support and a thermosensitive element containing a substantially light-insensitive organic silver salt, 1,2-dihydroxyphenyl-compound in thermal working relationship therewith and a binder, wherein the 1,2-dihydroxyphenyl-compound is represented by formula (I):

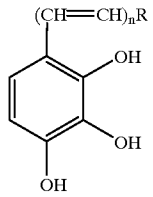

where n is 0 or 1; R is —(C=O)$R^1$, —(C=O)$NR^1R^2$, —CN, —$SO_3R^2$, $SO_2R^2$, —$SOR^2$, —$SO_2NR^2R^3$ or —$PO_3R^2R^3$; $R^1$ is H or an alkyl group with 12 or less carbon atoms; and $R^1$ and $R^3$ are independently H or an alkyl or an aryl group; and $R^1$ and $R^2$ can together provide the atoms to close a carbocyclic or heterocyclic ring; and $R^2$ and $R^3$ can together represent the atoms to close a carbocyclic or heterocyclic ring.

A recording process is also provided comprising the steps of: (i) providing the above-described substantially light-insensitive black and white monosheet thermographic recording material; (ii) bringing an outermost layer of the recording material into proximity with a heat source; (iii) applying heat from a heat source image-wise to the recording material while maintaining proximity to the heat source to produce an image; and (iv) removing the recording material from the heat source.

Preferred embodiments of the present invention are disclosed in the detailed description of the invention.

DETAILED DESCRIPTION OF THE INVENTION

According to a preferred embodiment of the recording process according to the present invention the heat source is a thermal head.

Organic reducing agents

The organic reducing agent used in the thermographic recording materials of the present invention is a 2,3,4-trihydroxyphenyl-compound represented by formula (I). The alkyl group with 12 or less carbon atoms of $R^1$ may also be a substituted alkyl group with 12 or less carbon atoms. The alkyl or aryl groups of $R^2$ or $R^3$ may also be substituted. In a preferred embodiment the —(CH=CH)$_n$R group has a Hammett substituent constant $\sigma_p$ greater than 0.25. Hammett substituent constants are, for example, listed on pages 28 and 29 of Advances in Linear Free Energy Relationships, edited by N. B. Chapman and J. Shorter and published by Plenum Press, London in 1972. Particularly preferred —(CH=CH)$_n$R groups are formyl, oxo-alkyl, oxo-aryl, cyano, carbamido, diphenoxyphosphoryl, alkylsulfinyl, alkylsulfonyl and sulfonylamino groups.

Preferred reducing agents for use in the present invention are selected from the group consisting of: consisting of: 2,3,4-trihydroxy-acetophenone, 2,3,4-trihydroxy-propionophenone, 2,3,4-trihydroxybenzaldehyde and 2,3,4-trihydroxybenzonitrile.

Compounds according to formula(I) are long known, the synthesis of a wide range of 2,3,4-trihydroxy-phenyl-oxo-derivatives, for example being described in Beilsteins Handbuch der Organischen Chemie, Vierte Auflage, Achter Band, Springer Verlag, Berlin (1925): p. 388, 393, 398, 399, 400, 417, 684 and 685. 2,3,4-trihydroxy-benzaldehyde, 2',3',4'-trihydroxyacetophenone, 2,3,4-trihydroxybenzophenone are all commercially available from Aldrich and can be used to produce other derivatives such as 2,3,4-trihydroxybenzonitrile by methods known to synthetic chemists.

Auxiliary reducing agents

The reducing agents used in accordance with the present invention being considered as primary or main reducing agents may be used in conjunction with so-called auxiliary reducing agents. Such auxiliary reducing agents are e.g. hydroquinone or catechol substituted with strongly electron-withdrawing groups such as sulfonic acid groups; hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; 2-substituted malondialdehyde compounds such as disclosed in U.S. Pat. No. 5,654,130.

In a preferred embodiment of the present invention the thermographic material comprises a support and a thermosensitive element which further contains a 3,4-dihydroxyphenyl compound with ethyl 3,4-dihydroxybenzoate, butyl 3,4-dihydroxybenzoate and 3,4-dihydroxybenzoic acid being particularly preferred.

Substantially

By substantially light-insensitive is meant not intentionally light sensitive. A substituted or unsubstituted alkyl group with 12 carbon atoms or less includes: methyl, ethyl, n-propyl, isopropyl, n-butyl, tertiary butyl, secondary butyl, n-pentyl, n-hexyl, cyclohexyl, n-heptyl, 2-ethylhexyl, n-octyl, n-nonyl, n-decyl, n-undecyl and n-dodecyl groups.

Thermosensitive element

According to the present invention, a thermographic recording material is provided comprising a thermosensitive element including a substantially light-insensitive organic silver salt, a reducing agent according to formula (I) in thermal working relationship therewith and a binder. The thermosensitive element may comprise a layer system in which the ingredients may be dispersed in different layers, with the proviso that the substantially light-insensitive organic silver salt and the reducing agent according to formula (I) are in thermal working relationship with one another i.e. during the thermal development process the reducing agent according to formula (I) must be present in such a way that it is able to diffuse to the substantially light-insensitive organic silver salt particles so that reduction of the substantially light-insensitive organic silver salt can take place.

Organic silver salts

Preferred substantially light-insensitive organic silver salts for use in the thermographic recording materials, according to the present invention, are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the thermographic recording materials of the present invention. A preferred process for producing a suspension of particles containing a substantially light-insensitive organic silver salt is disclosed in EP-A 754 969.

Binder

The thermosensitive element of the thermographic recording materials of the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously: e.g. cellulose derivatives, cellulose esters, carboxymethylcellulose, starch ethers, galactomannan, polyurethanes, polycarbonates, polyesters, polymers derived from α,β-ethylenically unsaturated compounds such as after-chlorinated polyvinyl chloride, partially hydrolyzed polyvinyl acetate, polyvinyl alcohol, polyvinyl acetals, preferably polyvinyl butyral, and homopolymers and copolymers produced using monomers selected from the group consisting of: vinyl chloride, vinylidene chloride, vinyl esters, acrylonitrile, acrylamides, methacrylamides. methacrylates, acrylates, methacrylic acid, acrylic acid, vinyl esters, styrenes, dienes and alkenes; or mixtures thereof.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine modified gelatines such as phthaloyl gelatine, polysaccharides, such as starch, gum arabic and dextran and water-soluble cellulose derivatives.

Suitable water-dispersible binders are any water-insoluble polymer. It should be noted that there is no clear cut transition between a polymer dispersion and a polymer solution in the case of very small polymer particles resulting in the smallest particles of the polymer being dissolved and those slightly larger being in dispersion.

The above mentioned binders or mixtures thereof may be used in conjunction with waxes or "heat solvents" also called "thermal solvents" or "thermosolvents" improving the reaction speed of the redox-reaction at elevated temperature.

Toning agents

In order to obtain a neutral black image tone thermographic recording materials according to the present invention may contain one or more toning agents. The toning agents should be in thermal working relationship with the substantially light-insensitive organic silver salt and reducing agents during thermal processing.

Any known toning agent from thermography or photothermography may be used. Particularly useful toning agents are the heterocyclic toner compounds of the benzoxazine dione or naphthoxazine dione type described in GB-P 1,439,478, U.S. Pat. No. 3,951,660 and U.S. Pat. No. 5,599,647.

Polycarboxylic acids and anhydrides thereof

According to a preferred embodiment of the present invention the substantially light-insensitive black and white monosheet thermographic recording material the thermosensitive element further contains at least one polycarboxylic acid and/or anhydride thereof in a molar percentage of at least 15 with respect to the substantially light-insensitive organic silver salt and in thermal working relationship therewith. The polycarboxylic acid may be aliphatic (saturated as well as unsaturated aliphatic and also cycloaliphatic) as disclosed in U.S. Pat. No. 5,527,758 or an aromatic polycarboxylic acid, may be substituted and may be used in anhydride form or partially esterified on the condition that at least two free carboxylic acids remain or are available in the heat recording step.

Stabilizers and antifoggants

In order to obtain improved shelf-life and reduced fogging, stabilizers and antifoggants may be incorporated into the thermographic recording materials of the present invention. Suitable stabilizers compounds are unsaturated carbocyclic or heterocyclic compounds substituted with a -SA group where A is hydrogen, a counterion to compensate the negative charge of the thiolate group or a group forming a symmetrical or an asymmetrical disulfide, for use in the present invention may be further substituted, which substitution also includes the atoms necessary to form an annulated unsaturated carbocyclic or heterocyclic ring system. Preferred substituents include acylamido, aryl-$SO_2NH$—, alkyl-$SO_2NH$—, aryl-$NHSO_2$-, alkyl-$NHSO_2$-, arylamino, alkyl, aryl, nitro and cyano groups and halogen atoms. Preferred stablizer compounds used in the present invention have an unsaturated 5- or 6-membered ring. Particularly suitable compounds are represented by formula (II):

(II)

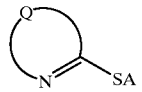

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide.

Surfactants and dispersants

Surfactants and dispersants aid the dispersion of ingredients which are insoluble in the particular dispersion medium. The thermographic recording materials of the present invention may contain one or more surfactants, which may be anionic, non-ionic or cationic surfactants and/or one or more dispersants. Suitable dispersants are natural polymeric substances, synthetic polymeric substances and finely divided powders, for example finely divided non-metallic inorganic powders such as silica.

Other ingredients

In addition to the ingredients the thermographic material may contain other additives such as free fatty acids, antistatic agents, e.g. non-ionic antistatic agents including a fluorocarbon group as e.g. in $F_3C(CF_2)_6CONH(CH_2CH_2O)$-H, silicone oil, ultraviolet light absorbing compounds, white light reflecting and/or ultraviolet radiation reflecting pigments, silica, and/or optical brightening agents.

Support

The support for the thermographic material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated heat-sensitive recording layer. The support may be made of an opacified resin composition.

Protective layer

In a preferred embodiment of the present invention a protective layer is provided for the thermosensitive element. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating.

A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. Suitable slipping layer compositions are described, for example, in U.S. Pat. No. 5,587,350, U.S. Pat. No. 5,536,696, U.S. Pat. No. 5,547,914, WO 95/12495, EP-A 775 592 and EP-A 775 595.

Coating techniques

The coating of any layer of the thermographic recording materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500g/cm$^2$ to ensure a good transfer of heat. In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly or from an intermediary storage means, optionally linked to a digital image work station wherein the image information can be processed to satisfy particular needs.

Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulsewise. When used in thermographic recording operating with thermal printheads the thermographic recording materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into the material. Image- or pattern-wise heating of the thermographic material may also proceed by means of pixel-wise modulated ultra-sound.

Industrial application

Thermographic recording materials according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

The following examples and comparative examples illustrate the present invention. The percentages and ratios used in the examples are by weight unless otherwise indicated. The following ingredients were used in the thermosensitive element in addition to those mentioned above:

AgBeh=silver behenate;

BR 18=PIOLOFORM BR 18, a polyvinyl butyral from WACKER CHEMIE;

CR01=ethyl 3,4-dihydroxybenzoate, according to U.S. Pat. No. 5,582,953;

CR02=propyl gallate;

CR03=propyl 2,3,4-trihydroxybenzoate;

CR04=3,4-dihydroxybenzonitrile, according to EP-A 903 625;

CR05=3,3,3',3'-tetramethyl-1,1'-spirobisindane-5,5',6,6'-tetrol, according to EP-A 599 369;

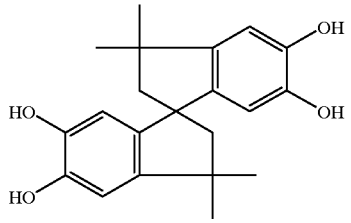

R01=2,3,4-trihydroxy-acetophenone;

R02=2,3,4-trihydroxy-propionophenone;

R03=2,3,4-trihydroxy-benzaldehyde;

R04=2,3,4-trihydroxy-benzophenone;

S01=tetrachlorophthalic anhydride;

S02=3'-decanoylamino-1-phenyl-1H-tetrazole-5-thiol

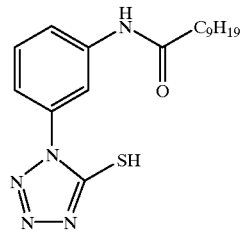

T01=7-(ethylcarbonato)benzo[e][1,3]oxazine-2,4-dione;

Oil=Baysilon™ MA, a silicone oil from BAYER AG.

COMPARATIVE EXAMPLES 1 to 4 and INVENTION EXAMPLE 1

Preparation of a silver behenate dispersion 72 kg of a 25% solution of BR 18 in 2-butanone, 180 kg of silver behenate and 455 kg 2-butanone were mixed for in a ball mill. After 4 days 72 kg of a 25% solution of BR 18 in 2-butanone and 22 kg of 2-butanone were added and then mixed in the ball mill for several days more. 576 kg of a 25% solution of BR 18 in 2-butanone, 0.684 kg of oil, 326.2 kg of 2-butanone and 10.08 g of T01 were then added and the mixture further mixed for 10 hours in the ball mill. The final 2-butanone dispersion contained 10.5% of silver behenate, 10.5% of BR 18, 0.59% of T01 and 0.04% of oil.

Preparation of the thermosensitive element

The subbed 120 μm thick polyethylene terephthalate support was doctor blade-coated with a composition containing 2-butanone as solvent/dispersing medium so as to obtain thereon, after drying for 30 minutes at 50° C., a thermosensitive element with the compositions summarized in table 1 below:

TABLE 1

| | AgBeh coverage | reducing agent | | BR 18 | Oil | T01 | S01 | S02 |
|---|---|---|---|---|---|---|---|---|
| | [g/m²] | type | [g/m²] | [g/m²] | [g/m²] | [g/m²] | [g/m²] | [g/m²] |
| Comparative example nr | | | | | | | | |
| 1 | 5.35 | CR01 | 1.091 | 5.35 | 20.4 | 0.300 | 0.128 | 0.117 |
| 2 | 5.35 | CR02 | 1.274 | 5.35 | 20.4 | 0.300 | 0.128 | 0.117 |
| Invention example nr 1 | 5.40 | R02 | 1.126 | 5.40 | 20.6 | 0.302 | 0.130 | 0.118 |

Thermographic printing

During printing of the recording materials of COMPARATIVE EXAMPLES 1 & 2 and INVENTION EXAMPLE 1 the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The printer was equipped with a thin film thermal head with a resolution of 300 dpi and was operated with a line time of 6.5 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic recording materials of COMPARATIVE EXAMPLES 1 & 2 and INVENTION EXAMPLE 1.

The maximum and minimum densities of the prints given in table 2 were measured through a visible or blue filter with a MACBETHM™ TR924 densitometer in the grey scale step corresponding to data levels of 64 and 0 respectively and are given in table 2.

For evaluating the steepness of the gradation of the thermographic recording materials of COMPARATIVE EXAMPLES 1 & 2 and INVENTION EXAMPLE 1 the numerical gradation value (NGV) corresponding with the quotient of the fraction $[2.5-(1.0+D_{min})]/[E_{2.5}-E_{(1.0+Dmin)}]$ was determined, wherein $E_{2.5}$ is the energy in Joule applied in a dot area of 87 μm×87 μm of the imaging layer that obtains by the energy an optical density value of 2.5, and $E_{(1.0+Dmin)}$ is the energy in Joule applied in a dot area of the imaging layer material that obtains by the energy an optical density value of $(1.0+D_{min})$. The applied energy in Joule is actually the electrical input energy measured for each resistor of the thermal head. The NGV's for the thermographic recording materials of COMPARATIVE EXAMPLES 1 & 2 and INVENTION EXAMPLE 1 are given in table 2.

Light box test

The light stability of the image background of the prints made with the thermographic recording materials of COMPARATIVE EXAMPLES 1 & 2 and INVENTION EXAMPLE 1 was evaluated on the basis CIELAB-values. The CIELAB-values were determined by spectrophotometric measurements according to ASTM Norm E179-90 in a R(45/0) geometry with evaluation according to ASTM Norm E308-90. The light box test consisted of first heating the thermographic materials of COMPARATIVE EXAMPLES 1 & 2 and INVENTION EXAMPLE 1 for 2 days at 57° C. and 34% relative humidity and then exposing them on top of the white PVC window of a specially constructed light-box for 3 days in a VOTSCH conditioning cupboard set at 30° C. and a relative humidity of 80%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The a* and b* CIELAB of the thermographic recording materials of COMPARATIVE EXAMPLES 1 & 2 and INVENTION EXAMPLE 1 determined after the light box test are summarized in table 2.

TABLE 2

| | reducing agent | fresh print | | | | 2d at 57° C./34% RH in dark then 3d at 30° C./ 85% RH on light box | |
|---|---|---|---|---|---|---|---|
| | | $D_{max}/D_{min}$ | | at $D_{min}$ | | | |
| | agent nr | (vis) | NGV | a* | b* | a* at $D_{min}$ | b* at $D_{min}$ |
| Comparative example number | | | | | | | |
| 1 | CR01 | 2.70/0.05 | 13.5 | 0.00 | 1.14 | 0.04 | 3.19 |
| 2 | CR02 | 3.64/0.05 | 21.6 | 0.03 | 1.28 | 0.61 | 9.07 |
| Invention example nr 1 | R02 | 4.08/0.05 | 22.3 | −0.15 | 1.88 | 0.20 | 6.25 |

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming yellower as b* becomes more positive.

The results of the thermographic evaluation of the thermographic recording materials of INVENTION EXAMPLE 1 and COMPARATIVE EXAMPLES 1 & 2 show that the thermographic recording material of INVENTION EXAMPLE 1, incorporating a novel reducing agent in the thermographic recording material according to the present invention, is clearly more thermosensitive than the thermographic recording materials of COMPARATIVE EXAMPLES 1 & 2, as evidenced by its higher $D_{max}$ value. Despite this higher thermosensitivity the thermographic recording material of INVENTION EXAMPLE 1 exhibited a gradation (NGV value) comparable or superior to that of the thermographic recording materials of COMPARATIVE EXAMPLES 1 & 2 and comparable CIELAB a* and b* values.

COMPARATIVE EXAMPLES 3 to 5 and INVENTION EXAMPLES 2 and 3

The thermosensitive elements of the thermographic recording materials of COMPARATIVE EXAMPLE 3 to 5 and INVENTION EXAMPLES 2 and 3 were prepared as described for COMPARATIVE EXAMPLES 1 & 2 and INVENTION EXAMPLE 1. The compositions of the thermosensitive elements are given in table 3 below.

TABLE 3

| | AgBeh coverage | reducing agent | | BR 18 | Oil | T01 | S01 | S02 |
|---|---|---|---|---|---|---|---|---|
| | [g/m²] | type | [g/m²] | [g/m²] | [g/m²] | [g/m²] | [g/m²] | [g/m²] |
| Comparative example nr | | | | | | | | |
| 3 | 6.27 | CR01 | 1.279 | 6.27 | 23.9 | 0.351 | 0.150 | 0.137 |
| 4 | 6.59 | CR02 | 1.570 | 6.59 | 25.1 | 0.369 | 0.158 | 0.144 |
| 5 | 6.06 | CR03 | 1.444 | 6.06 | 23.1 | 0.339 | 0.145 | 0.132 |
| Invention example nr | | | | | | | | |
| 2 | 6.14 | R01 | 1.156 | 6.14 | 23.4 | 0.344 | 0.147 | 0.134 |
| 3 | 6.37 | R02 | 1.328 | 6.37 | 24.3 | 0.357 | 0.153 | 0.139 |

The thermographic recording materials of COMPARATIVE EXAMPLES 3 to 5 and INVENTION EXAMPLES 2 and 3 were evaluated as described above for COMPARATIVE EXAMPLES 1 & 2 and INVENTION EXAMPLE 1. The results are given in table 4 below.

The results of the thermographic evaluation of the thermographic recording materials of INVENTION EXAMPLE 2 and 3 and COMPARATIVE EXAMPLES 3 to 5 show that the thermographic recording material of INVENTION EXAMPLES 2 and 3, incorporating novel reducing agents in the thermographic recording material according to the present invention, exhibit a higher thermal sensitivity (i.e. higher $D_{max}$–value) and comparable or higher gradations (i.e. higher comparable or higher NGV values) to those of COMPARATIVE EXAMPLES 3 to 5. Despite their higher thermal sensitivities, the thermographic recording materials of INVENTION EXAMPLES 2 & 3 exhibit comparable or more neutral CIELAB a*- and b*-values after the light box test.

TABLE 4

| | reducing agent nr | fresh print $D_{max}/D_{min}$ (vis) | NCV | 2d at 57° C./34% RH in dark then 3d at 30° C./ 85% RH on light box a* at $D_{min}$ | b* at $D_{min}$ |
|---|---|---|---|---|---|
| Comparative example nr | | | | | |
| 3 | CR01 | 3.35/0.05 | 14.5 | −0.17 | 8.84 |
| 4 | CR02 | 4.09/0.05 | 24.0 | −0.05 | 12.40 |
| 5 | CR03 | 3.61/0.05 | 22.7 | 1.36 | 15.39 |
| Invention example nr | | | | | |
| 2 | R01 | 4.63/0.05 | 25.7 | −0.59 | 9.86 |
| 3 | R02 | 4.43/0.05 | 24.2 | −0.37 | 9.63 |

COMPARATIVE EXAMPLES 7 and INVENTION EXAMPLES 4 to 7

The thermosensitive elements of the thermographic recording materials of COMPARATIVE EXAMPLE 6 and INVENTION EXAMPLES 4 to 7 were prepared as described for COMPARATIVE EXAMPLES 1 & 2 and INVENTION EXAMPLE 1. The compositions of the thermosensitive elements are given in table 5 below.

TABLE 5

| | AgBeh coverage [g/m²] | reducing agent type | reducing agent [g/m²] | BR 18 [g/m²] | Oil [g/m²] | T01 [g/m²] | S01 [g/m²] | S02 [g/m²] |
|---|---|---|---|---|---|---|---|---|
| Comparative example nr | | | | | | | | |
| 6 | 7.6 | CR01 | 1.536 | 7.6 | 28.7 | 0.422 | 0.181 | 0.164 |
| Invention example nr | | | | | | | | |
| 4 | 6.9 | R01 | 1.286 | 6.9 | 26.1 | 0.383 | 0.164 | 0.148 |
| 5 | 10.5 | R02 | 2.160 | 10.5 | 39.5 | 0.580 | 0.249 | 0.225 |
| 6 | 9.6 | R03 | 1.633 | 9.6 | 3.61 | 0.529 | 0.227 | 0.205 |
| 7 | 8.9 | R04 | 2.250 | 8.9 | 3.33 | 0.489 | 0.209 | 0.189 |

The thermographic recording materials of COMPARATIVE EXAMPLES 7 and INVENTION EXAMPLES 4 to 7 were evaluated as described above for COMPARATIVE EXAMPLES 1 & 2 and INVENTION EXAMPLE 1. The results are given in table 6 below.

The results of the thermographic evaluation of the thermographic recording materials of INVENTION EXAMPLE 4 to 7 and COMPARATIVE EXAMPLE 6 show that the thermographic recording material of INVENTION EXAMPLES 4 to 7, incorporating novel reducing agents in the thermographic recording material according to the present invention, have higher thermosensitivities (i.e. higher $D_{max}$ values) and higher gradations (i.e. higher NGV values) than those of the thermographic recording material of COMPARATIVE EXAMPLE 6.

TABLE 6

| | reducing agent nr | fresh print $D_{max}/D_{min}$ (vis) | NGV |
|---|---|---|---|
| Comparative example nr | | | |
| 6 | CR01 | 3.40/0.05 | 12.0 |
| Invention example nr | | | |
| 4 | R01 | 5.61/0.06 | 23.7 |
| 5 | R02 | 5.50/0.05 | 25.6 |
| 6 | R03 | 5.36/0.05 | 25.3 |
| 7 | R04 | 4.42/0.04 | 21.4 |

COMPARATIVE EXAMPLES 7 to 9 and INVENTION EXAMPLES 8 & 9

The thermosensitive elements of the thermographic recording materials of COMPARATIVE EXAMPLE 7 to 9 and INVENTION EXAMPLES 8 & 9 were prepared as described for COMPARATIVE EXAMPLES 1 & 2 and INVENTION EXAMPLE 1. The compositions of the thermosensitive elements are given in table 7 below.

TABLE 7

| | AgBeh coverage | reducing agent | | BR 18 | Oil | T01 | S01 | S02 |
|---|---|---|---|---|---|---|---|---|
| | [g/m²] | type | [g/m²] | [g/m²] | [g/m²] | [g/m²] | [g/m²] | [g/m²] |
| Comparative example nr | | | | | | | | |
| 7 | 5.51 | CR02 | 1.312 | 5.51 | 20.9 | 0.309 | 0.132 | 0.120 |
| 8 | 5.48 | CR04 | 0.829 | 5.48 | 20.8 | 0.307 | 0.132 | 0.119 |
| 9 | 5.58 | CR05 | 2.127 | 5.58 | 21.2 | 0.312 | 0.134 | 0.122 |
| Invention example nr | | | | | | | | |
| 8 | 5.58 | R01 | 1.050 | 5.58 | 21.2 | 0.312 | 0.134 | 0.122 |
| 9 | 5.45 | R02 | 1.112 | 5.45 | 20.7 | 0.305 | 0.131 | 0.119 |

The thermographic recording materials of COMPARATIVE EXAMPLES 7 to 9 and INVENTION EXAMPLES 8 & 9 were evaluated as described above for COMPARATIVE EXAMPLES 1 & 2 and INVENTION EXAMPLE 1. The results are given in table 8 below.

TABLE 8

| | reducing agent nr | fresh print $D_{max}/D_{min}$ (vis) | NGV |
|---|---|---|---|
| Comparative example nr | | | |
| 7 | CR02 | 4.12/0.05 | 26.11 |
| 8 | CR04 | 2.97/0.05 | 19.42 |
| 9 | CR05 | 2.76/0.05 | 16.75 |
| Invention example nr | | | |
| 8 | R01 | 4.61/0.05 | 30.22 |
| 9 | R02 | 4.35/0.05 | 32.36 |

The results of the thermographic evaluation of the thermographic recording materials of INVENTION EXAMPLE 8 and 9 and COMPARATIVE EXAMPLES 7 to 9 show that the thermographic recording material of INVENTION EXAMPLES 8 & 9, incorporating novel reducing agents in the thermographic recording material according to the present invention, exhibit higher thermosensitivities (i.e. $D_{max}$ values) and high gradations (i.e. higher NGV values) than those of the thermographic recording materials of COMPARATIVE EXAMPLES 7 to 9 using reducing agents according to the teachings of U.S. Pat. No. 5,582,953, EP-A 903 625 and EP-A 599 369 respectively.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white monosheet thermographic recording material comprising a support and a thermosensitive element containing a reducing agent comprising substantially light-insensitive organic silver salt, a 1,2-dihydroxyphenyl-compound in thermal working relationship therewith and a binder, wherein said 1,2-dihydroxyphenyl-compound is represented by formula (I):

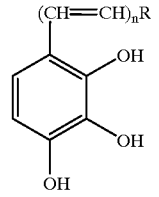

where n is 0 or 1; R is —(C═O)$R^1$, —(C═O)$NR^1R^2$, —CN, —$SO_3R^2$, —$SO_2R^2$, —$SOR^2$, —$SO_2NR^2R^3$ or —$PO_3R^2R^3$; $R^1$ is H or an alkyl group with 12 or less carbon atoms; and $R^2$ and $R^3$ are independently H or an alkyl or an aryl group; and $R^1$ and $R^2$ together can provide the atoms to close a carbocyclic or heterocyclic ring; and $R^2$ and $R^3$ together can represent the atoms to close a carbocyclic or heterocyclic ring.

2. Substantially light-insensitive black and white monosheet thermographic recording material according to claim 1, wherein said compound represented by formula (I) has n=0 and R is selected from the group consisting of formyl, oxo-alkyl, oxo-aryl, cyano, carbamido, diphenoxyphosphoryl, alkylsulfinyl, alkylsulfonyl and sulfonylamino groups.

3. Substantially light-insensitive black and white monosheet thermographic recording material according to claim 1, wherein said reducing agent is selected from the group of compounds consisting of: 2,3.4-trihydroxy-acetophenone, 2,3,4-trihydroxy-propionophenone, 2,3.4-trihydroxybenzaldehyde and 2,3,4-trihydroxybenzonitrile.

4. Substantially light-insensitive black and white monosheet thermographic recording material according claim 1, wherein said thermosensitive element further contains at least one polycarboxylic acid and/or anhydride thereof in a molar percentage of at least 15 with respect to said substantially light-insensitive organic silver salt and in thermal working relationship therewith.

5. Substantially light-insensitive black and white monosheet thermographic recording material according to claim 1, wherein said thermosensitive element is provided with a protective layer.

6. Substantially light-insensitive black and white monosheet thermographic recording material according to claim 1, wherein said substantially light-insensitive organic silver salt is a silver salt of an organic carboxylic acid.

7. A recording process comprising the steps of: (i) providing a substantially light-insensitive black and white monosheet thermographic recording material including a support and a thermosensitive element containing a substantially light-insensitive organic silver salt, a 1,2-dihydroxyphenyl-compound in thermal working relationship therewith and a binder; (ii) bringing an outermost layer of said recording material into proximity with a heat source; (iii) applying heat from a heat source image-wise to said recording material while maintaining proximity to said heat source to produce an image; and (iv) removing said recording material from said heat source, wherein said 1,2-dihydroxyphenyl-compound is represented by formula (I):

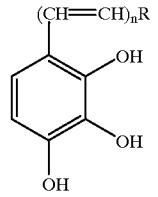

where n is 0 or 1; R is —(C═O)$R^1$, —(C═O)$NR^1R^2$, —CN, —$SO_3R$, —$SO_2R^2$, —$SOR^2$, —$SO_2NR^2R^3$ or —$PO_3R^2R^3$; $R^1$ is H or an alkyl group with 12 or less carbon atoms; and $R^2$ and $R^3$ are independently H or an alkyl or an aryl group; and $R^1$ and $R^2$ together can provide the atoms to close a carbocyclic or heterocyclic ring; and $R^2$ and $R_3$ together can represent the atoms to close a carbocyclic or heterocyclic ring.

8. Recording process according to claim 7, wherein said heat source is a thermal head.

* * * * *